US009437090B2

(12) United States Patent
Easter et al.

(10) Patent No.: US 9,437,090 B2
(45) Date of Patent: Sep. 6, 2016

(54) MOBILE EAS DEACTIVATOR

(71) Applicants: Ronald B. Easter, Parkland, FL (US); Douglas A. Drew, Boca Raton, FL (US)

(72) Inventors: Ronald B. Easter, Parkland, FL (US); Douglas A. Drew, Boca Raton, FL (US)

(73) Assignee: Tyco Fire & Security GmbH, Rheinfall (CH)

( * ) Notice: Subject to any disclaimer, the term of this patent is extended or adjusted under 35 U.S.C. 154(b) by 287 days.

(21) Appl. No.: 14/211,798

(22) Filed: Mar. 14, 2014

(65) Prior Publication Data

US 2014/0268472 A1 Sep. 18, 2014

Related U.S. Application Data

(60) Provisional application No. 61/784,929, filed on Mar. 14, 2013.

(51) Int. Cl.

| | |
|---|---|
| ***G08B 13/24*** | (2006.01) |
| ***H01F 13/00*** | (2006.01) |
| ***G07G 1/00*** | (2006.01) |

(52) U.S. Cl.

CPC ..... *G08B 13/2411* (2013.01); *G07G 1/00* (2013.01); *G08B 13/246* (2013.01); *H01F 13/006* (2013.01)

(58) Field of Classification Search

CPC ..... G08B 13/2411; G08B 13/2425; G08B 13/246

USPC ..... 361/149

See application file for complete search history.

(56) References Cited

U.S. PATENT DOCUMENTS

| | | | | |
|---|---|---|---|---|
| 5,963,134 | A | 10/1999 | Bowers et al. | |
| 6,060,988 | A * | 5/2000 | Copeland | G08B 13/242 340/551 |
| 6,700,489 | B1 * | 3/2004 | Easter | G08B 13/242 235/472.01 |
| 7,051,943 | B2 | 5/2006 | Leone et al. | |
| 7,250,866 | B2 | 7/2007 | Hall et al. | |
| 7,830,255 | B2 | 11/2010 | Leone | |
| 8,311,485 | B2 | 11/2012 | Dinh et al. | |

(Continued)

FOREIGN PATENT DOCUMENTS

| | | |
|---|---|---|
| EP | 1693778 A1 | 8/2008 |
| WO | 9306564 A1 | 4/1993 |

(Continued)

OTHER PUBLICATIONS

Mattsson, M., "Security and Infrastructure for Mobile Phone Payments Using Near Field Communication," Master of Science Thesis, MMK 2010:48 MDA 378, KHT Industrial Engineering and Management Machine Design, Stockholm, Sweden, (2010) (94 pages).

*Primary Examiner* — Stephen W Jackson
*Assistant Examiner* — Christopher Clark
(74) *Attorney, Agent, or Firm* — Fox Rothschild LLP; Robert J. Sacco; Carol E. Thorstad-Forsyth

(57) ABSTRACT

A deactivator device for a mobile Point of Sale (mPOS) systems includes a pair of spaced apart, fixed position electromagnets positioned and configured such that magnetic fields generated by the electromagnets aid one another to form a combined magnetic field; a battery; a capacitor; and an electronics assembly including a microcontroller configured to control storage of energy from the battery in the capacitor and to selectively provide a deactivation or activation pulse from the capacitor to the electromagnets. The components may be positioned in a housing configured for attachment to a mPOS mobile device.

17 Claims, 5 Drawing Sheets

(56) References Cited

U.S. PATENT DOCUMENTS

| | | | | |
|---|---|---|---|---|
| 8,439,263 | B2 | 5/2013 | Clark et al. | |
| 8,576,045 | B2 | 11/2013 | Allen et al. | |
| 2008/0107219 | A1 | 5/2008 | Oakes et al. | |
| 2008/0303673 | A1 | 12/2008 | Oung | |
| 2009/0212952 | A1* | 8/2009 | Yang | G08B 13/2411 340/572.3 |
| 2009/0261977 | A1* | 10/2009 | Leone | G08B 13/2411 340/572.8 |
| 2009/0295584 | A1 | 12/2009 | Leone | |
| 2010/0311328 | A1 | 12/2010 | Kargl | |
| 2012/0032803 | A1 | 2/2012 | Copeland et al. | |
| 2012/0112912 | A1 | 5/2012 | Berg | |
| 2013/0257619 | A1* | 10/2013 | Yang | G08B 13/2411 340/572.3 |
| 2013/0278425 | A1 | 10/2013 | Cunningham et al. | |

FOREIGN PATENT DOCUMENTS

| | | | |
|---|---|---|---|
| WO | 0184519 | A2 | 11/2001 |
| WO | 0243021 | A2 | 5/2002 |
| WO | 03008006 | A2 | 10/2003 |
| WO | 2006057887 | A1 | 6/2006 |
| WO | 2007114819 | A1 | 10/2007 |
| WO | 01/84519 | | 11/2011 |
| WO | 2013/192033 | | 12/2013 |

* cited by examiner

MOBILE EAS DEACTIVATOR

CROSS REFERENCE TO RELATED APPLICATIONS

This application claims the benefit of U.S. Provisional Application No. 61/784,929 filed on Mar. 14, 2013, the contents of which are incorporated herein by reference.

FIELD OF THE INVENTION

The present invention relates generally to Electronic Article Surveillance (EAS) systems, and more specifically to a EAS functions in a mobile Point of Sale (mPOS) retail system.

BACKGROUND OF THE INVENTION

Recently some retailers have introduced mobile Point of Sale (mPOS) service in which a store employee meets a customer somewhere on the sales floor and uses a handheld device (e.g., phone or tablet) to create an invoice, transact a payment step (e.g., using the customer's credit card), create a receipt (usually electronic), and send details of the sale to the store's backend system for processing (e.g., updating the store's sales totals and perpetual inventory databases).

EAS systems are well known in the art and are used for inventory control and to prevent theft and similar unauthorized removal of articles from a controlled area. Typically, in such systems a system transmitter and a system receiver are used to establish a surveillance zone which must be traversed by any articles being removed from the controlled area.

An EAS security tag is affixed to each article and includes a marker or sensor adapted to interact with a signal being transmitted by the system transmitter into the surveillance zone. For systems using acousto-magnetic EAS tags, a frequency of 58 kHz is used to establish the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone.

In an mPOS retail system, checkout will be performed by mobile devices, for example a smartphone or tablet device incorporating the necessary software. If is required to deactivate the EAS at a stationary location, for example, at a stationary point of sale, the benefits of mPOS may be hampered. Accordingly, it is desirable to provide the EAS tag deactivation such that it is associated with the mobile device utilized for the mPOS checkout.

Prior art deactivators are corded (i.e. not mobile) or too large and heavy to be used in a mPOS system. Previous cordless products were much larger and designed to be standalone. For example, many conventional deactivators require a large high-voltage capacitor and a large coil antenna, which translates into a large, bulky and heavy deactivator. The weight, cost and volume of such a deactivation solution limits the portability and usability the device. Further, the large energy requirement of the device eliminates the possibility of powering the unit with a battery or other small power source. As such, conventional deactivators that are battery operated require large heavy batteries, thereby further increasing the size and weight of the device.

Another type of conventional deactivator uses a magnetic field produced by a pair of permanent magnets that are spun around by an electric motor (such as a DC motor) to deactivate the EAS tag or article. Since the DC motor itself is powered using a magnetic field, this arrangement requires the use of two separate and independent magnetic fields that must be maintained. This increases the complexity and the number of parts of the system as well as the size and power requirements.

Thus, a need has arisen to overcome the problems with the prior art and more particularly for a more efficient, lightweight and user-friendly deactivator for EAS tags or articles useable with a mPOS system.

SUMMARY OF THE INVENTION

In at least one embodiment, the present invention provides a deactivator device for a mPOS systems. The deactivator device includes a pair of spaced apart, fixed position electromagnets which are positioned and configured such that magnetic fields generated by the electromagnets aid one another to form a combined magnetic field. The device further includes a battery, a capacitor, and an electronics assembly. The electronics assembly includes a microcontroller configured to control storage of energy from the battery in the capacitor and to selectively provide a deactivation or activation pulse from the capacitor to the electromagnets.

In at least one embodiment, the deactivation device includes a housing in which the components are positioned. The housing is configured for attachment to a mPOS mobile device. In such an embodiment, the housing preferably has a two-dimensional form factor which is approximately equal to or less than a two-dimensional form factor of the mobile device.

In at least one embodiment, the present invention provides a mPOS assembly which includes a mPOS mobile device configured to carry out at least one point of sale transaction and a deactivator device coupled thereto. The deactivator device includes a pair of spaced apart, fixed position electromagnets which are positioned and configured such that magnetic fields generated by the electromagnets aid one another to form a combined magnetic field. The device further includes a battery, a capacitor, and an electronics assembly. The electronics assembly includes a microcontroller configured to control storage of energy from the battery in the capacitor and to selectively provide a deactivation or activation pulse from the capacitor to the electromagnets.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
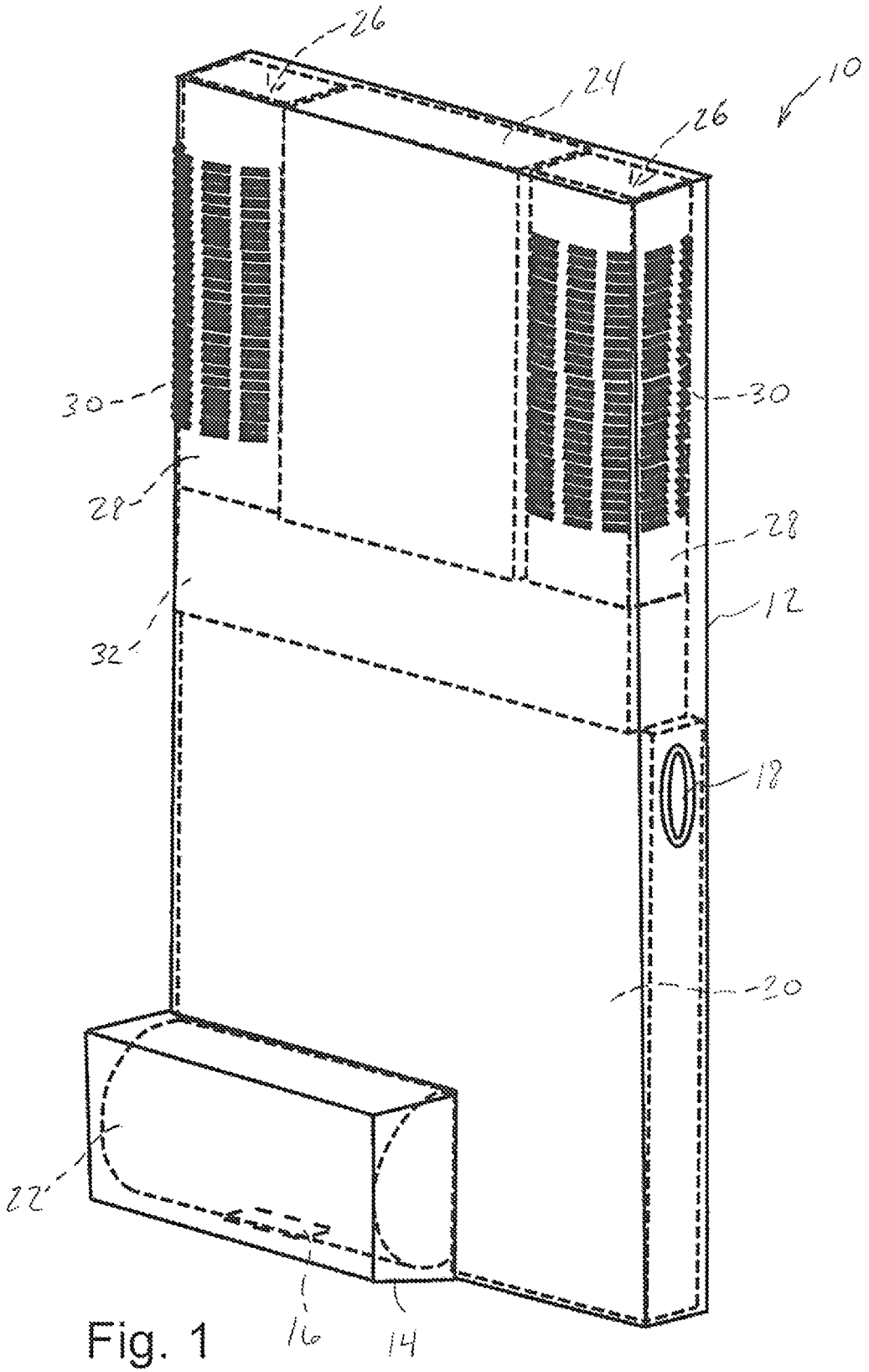
FIG. 1 is a perspective view of a deactivator device in accordance with an exemplary embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
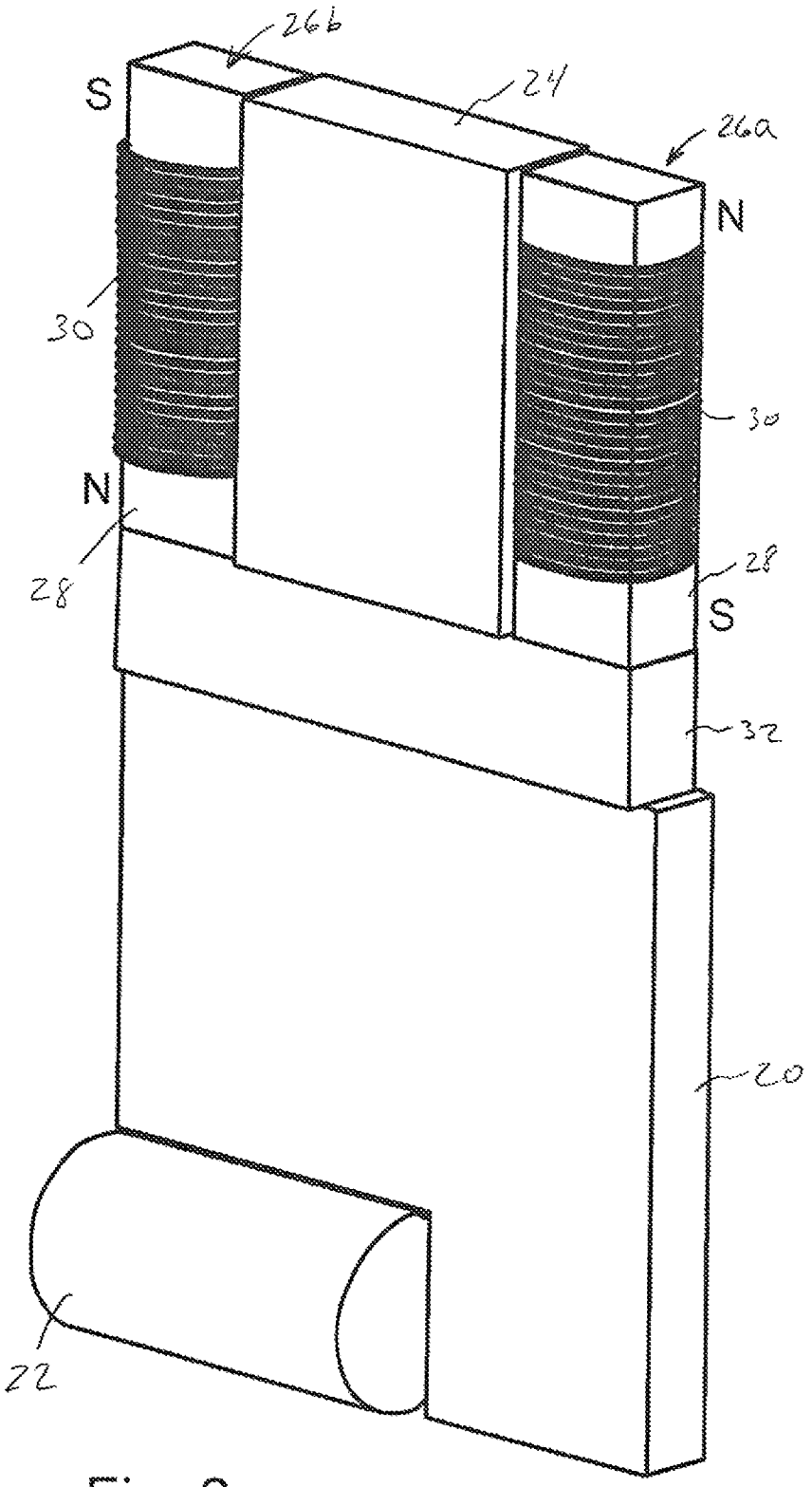
FIG. 2 is a perspective view of the deactivator device of FIG. 1 with the housing removed.

Referring to FIGS. 1 and 2, a mobile deactivator device 10 in accordance with an exemplary embodiment of the invention will be described. The exemplary deactivator device 10 includes a housing 12 with a battery compartment 14. The housing 12 and battery compartment 14 are preferably an enclosed, unitary structure, however, other structures may be utilized. Additionally, while the illustrated embodiment includes a projecting battery compartment 14, such is not required and the housing 12 and battery compartment 14 may have any desired configuration. As explained in hereinafter, the form factor of the housing 12 is preferably such that the deactivator device 10 may be connected to a mobile device 50 and generally fit within the form factor of the mobile device 50 (see FIG. 5). A charging input 16 preferably extends through the housing 12 for charging of the internal battery 22 and a trigger 18 communicates with a controller for activation of the device 10, as explained hereinafter.

Within the housing 12, the deactivation device 10 generally includes an electronic assembly 20, a capacitor 24 and a pair of fixed position, spaced apart electromagnets 26. Each electromagnet 26 includes a core 28 with a coil 30 wrapped thereabout. The cores 28 may be made from various materials, for example, iron powder or transformer steel. The coils 30 are made of conductive material, for example, copper. A return bar 32 may be provided between the electromagnets 26*a*, 26*b* and the electronic assembly 20 to reduce stray of the magnetic field, however, the return bar 32 is optional and may be removed to save weight. The capacitor 24 is positioned between the electromagnets 26*a*, 26*b* to help maintain a small form factor. The capacitor 24 preferably has a depth that is approximately equal to the depth of the electromagnets 26*a*, 26*b*.

Figure 3:
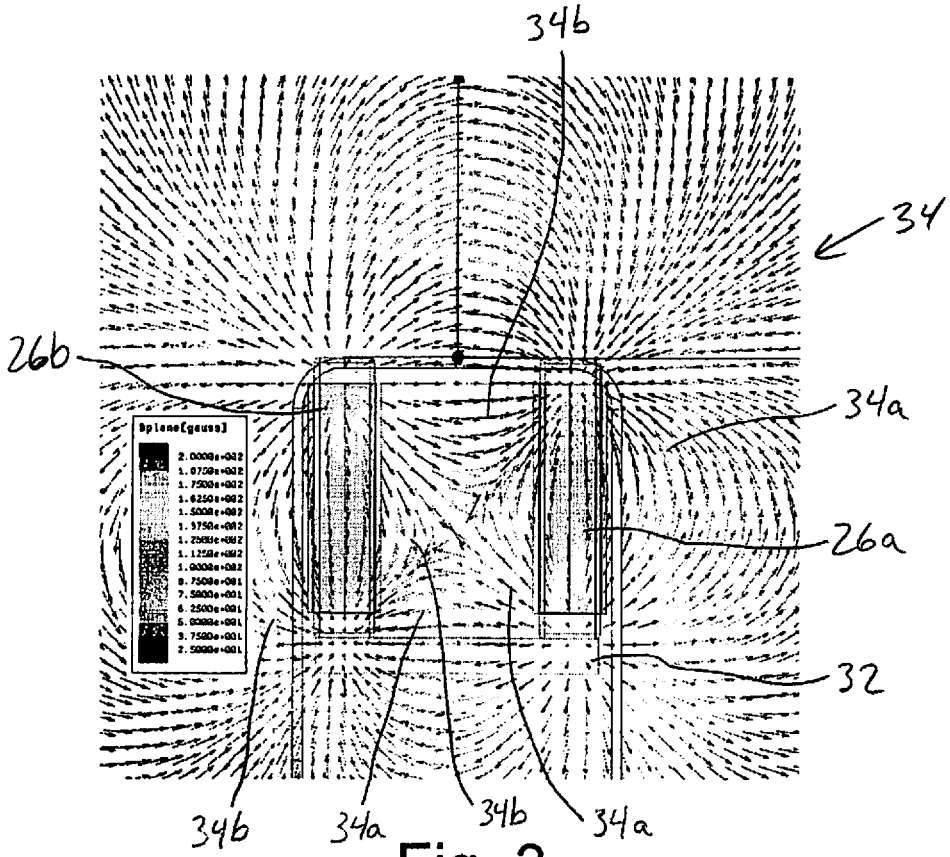
FIG. 3 is a schematic diagram illustrating a magnetic field pattern of the deactivator device of FIG. 1.

The electromagnets 26 are configured and positioned such that they have opposite polarities. In the illustrated embodiment, the upper end of the electromagnet 26*a* defines the north pole while the lower end defines the south pole and the upper end of the electromagnet 26*b* defines the south pole while the lower end defines the north pole. In this way, the magnetic field 34*a* of electromagnet 26*a* and the magnetic field 34*b* of electromagnet 26*b* aid one another to provide a combined magnetic field 34 as illustrated in FIG. 3. The combined magnetic field 34 allows the deactivation device 10 to produce the magnetic field 34 over a sufficient distance, for example 2 inches, while having a relatively small form factor and utilizing minimal energy, for example, a peak energy of 0.5 Joules.

Figure 4:
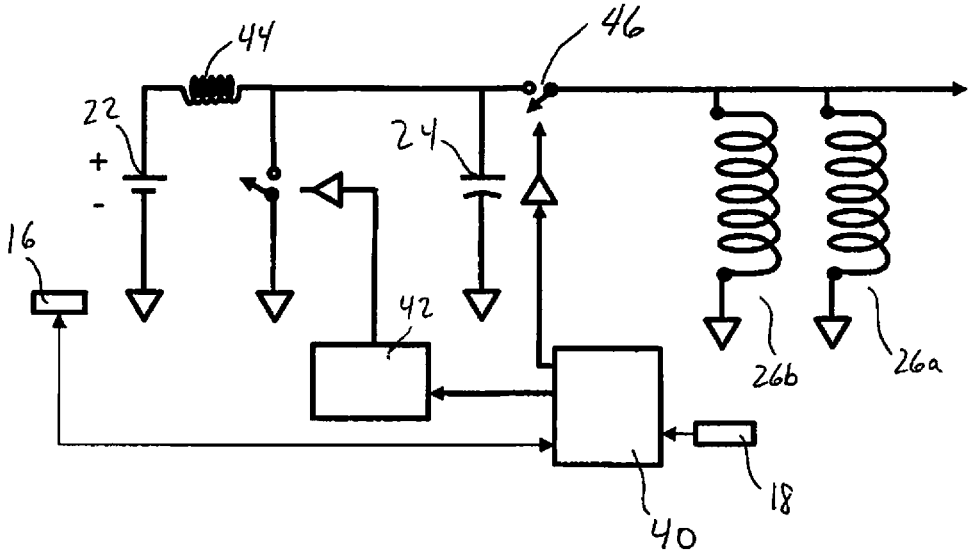
FIG. 4 is a schematic diagram of one embodiment for the electronic circuit of the deactivator device of the present invention.

Referring to FIG. 4, an example of a circuit to implement the deactivation device 10 is illustrated for generating the EAS tag deactivation pulse. For charging the battery 22, the microprocessor 40 communicates with the charging inlet 16. The charging inlet 16 is configured for connection to a docking station, charge cord or the like (not shown). The battery 22 may be any variety of rechargeable battery. The base interface circuit 610 may provide communication, charge signals, and power supply protection to microcontroller 40 to control charging of the battery 20.

For deactivation, the microprocessor 40 controls generation of an EAS tag deactivation pulse. A pulse width modulator 42, in conjunction with the capacitor 24 and an inductor 44, form a boost inverter which converts the nominal DC battery voltage from the battery 22 to a higher voltage, for example 125 V DC. When the switch 46 is closed on command from the microprocessor 40, for example, in response to activation of the trigger 18, the fully charged capacitor 24 is connected to the two coils 30. Alternatively, the device may not include a trigger 18, and the microprocessor 40 may instead automatically open and close the switch on a timed interval, for example, closed for 3 seconds and then opened for 12 seconds.

When the capacitor 24 is connected to the coils 30, such initiates a natural resonant discharge producing a decaying alternating sinusoidal current waveform in the coils 30. The deactivation frequency is preferably in the range of approximately 1.5 kHz & 3.5 kHz with a 25% decay rate. The inductance value, capacitance value and the initial voltage of the capacitor determine the strength of the current waveform. In an exemplary embodiment, with the magnetic fields 34*a*, 34*b* aiding each other, these parameters are sized to produce a relatively low strength current waveform, for example on the order of a peak energy level of about 0.5 Joules, which still provides the magnetic field 34 level of sufficient strength to deactivate an EAS tag out to a range of approximately 2 inches.

The deactivation device 10 may be configured to locate an EAS tag by sending at a sensing pulse, as is known in the art, however the illustrated embodiment does not include such a configuration. Instead, the illustrated device assumes the label orientation will be known. For example, the label orientation will coincide with the bar code. The device can be configured for either deactivation or re-activation of labels. The range required for re-activation range is less than that required for deactivation. An exemplary range of approximately one inch may be provided for re-activation, while approximately two inches is provided for deactivation.

Figure 5:
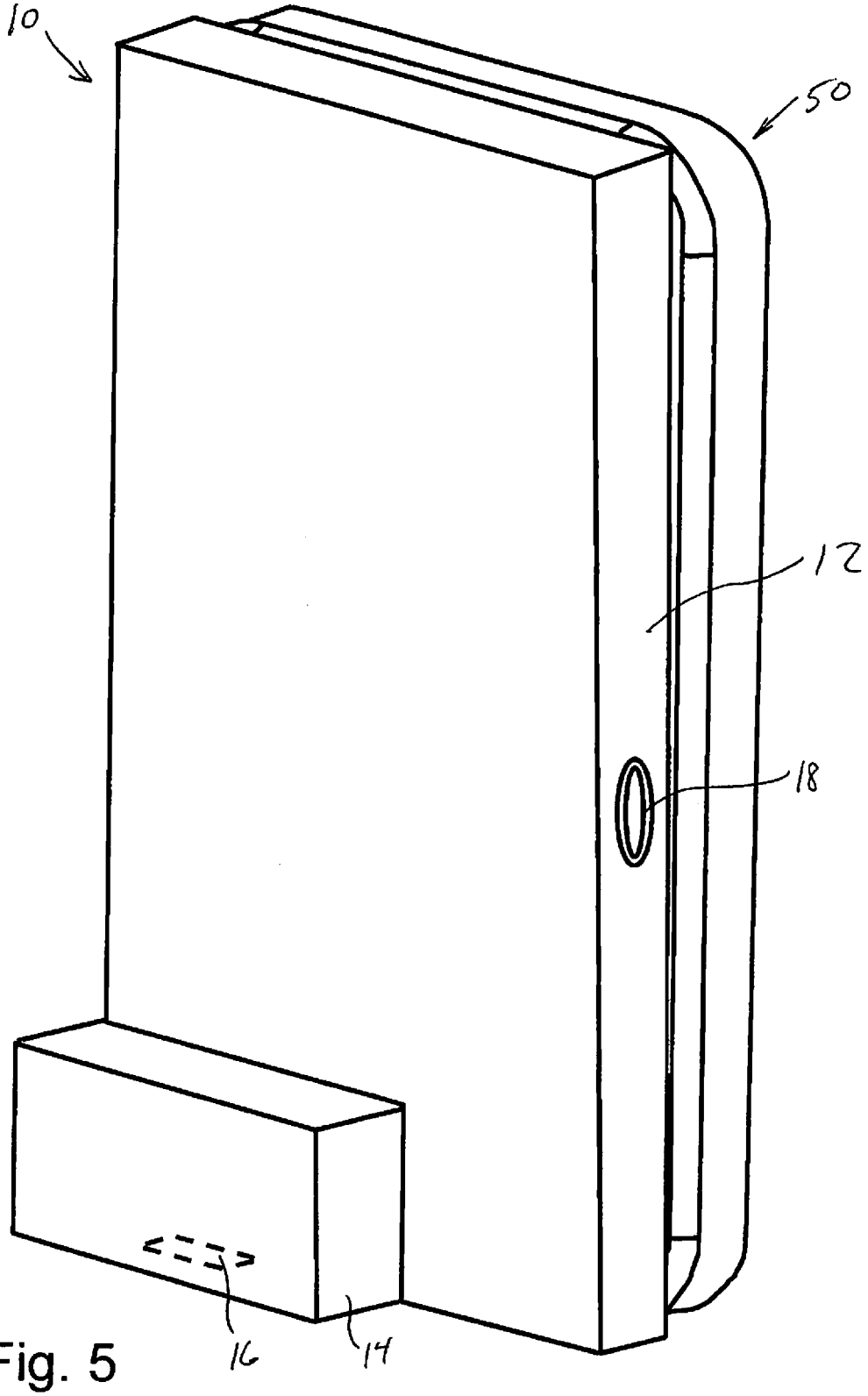
FIG. 5 is a perspective view of the exemplary deactivator device positioned in conjunction with a mobile device.
Figure 6:
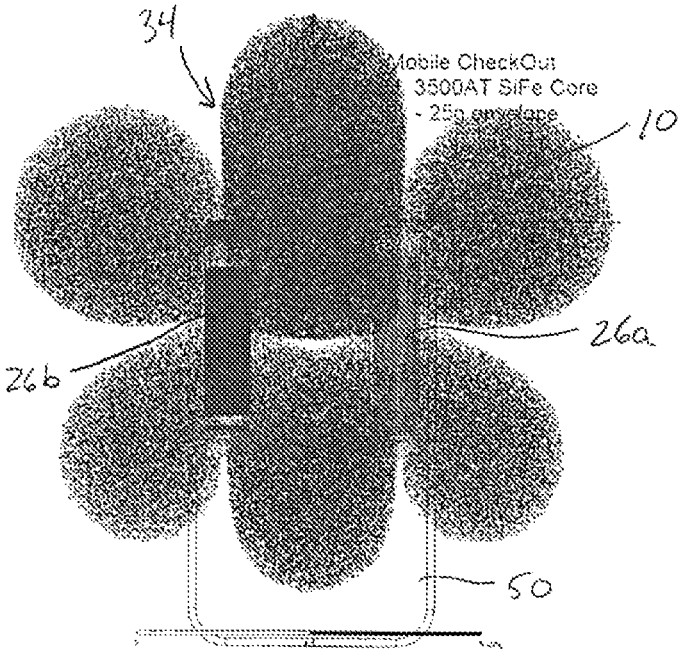
FIG. 6 is a schematic figure of the magnetic field of the deactivator device of FIG. 5 extending relative to the mobile device.

Referring to FIGS. 5 and 6, the deactivator device 10 is preferably configured to be coupled to a mobile device 50, for example a mobile phone or tablet. The housing 12 may be connected to the mobile device 50 utilizing any of various techniques. For example, the housing 12 may be coupled to the device 50 using a separable adhesive. Alternatively, a fastener, for example, hook and loop fastener, may be positioned between the housing 12 and the device 50. As yet another exemplary alternative, the housing 12 may be provided with clips or the like (not shown) which extend from the housing 12 and engage the mobile device 50 to facilitate such coupling. While the deactivation device 10 is coupled to the mobile device 50, the deactivation device 10 preferably operates independently thereof, having self-contained electronics and power. In this way, the deactivation device 10 may be interchanged between various mobile devices 50 without any system reconfiguration.

As illustrated in FIG. 5, the housing 12 preferably has a two-dimensional form factor, defined by its length and width, which is the same as or smaller than the two-dimensional form factor, defined by its length and width, of the mobile device such that the housing 12 does not extend substantially beyond the sides of the mobile device 50. The small size and light weight allow the user to perform mPOS with a minimal change to their accustomed equipment.

When the user wants to deactivate an EAS tag, they simply position the area of the electromagnets 26*a*, 26*b* proximate the EAS tag and press the trigger 18. If the device 10 does not include the trigger, then the deactivation device 10 would be maintained proximate to the EAS tag at least long enough for the microcontroller 40 to complete one cycle of the automatic closing and opening of the switch 46. As illustrated in FIG. 6, upon activation of the deactivation device 10, the magnetic field 34 extends laterally and perpendicularly from the mobile device 50.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A deactivator device for a mobile Point of Sale (mPOS) system, comprising:

a pair of spaced apart, fixed position electromagnets positioned and configured such that magnetic fields generated by the electromagnets aid one another to form a combined magnetic field that is of sufficient strength to deactivate a security tag in proximity to the mPOS system;

a battery;

a capacitor;

an electronics assembly including a microcontroller configured to control storage of energy from the battery in the capacitor and to selectively provide a deactivation or activation pulse from the capacitor to the electromagnets; and a housing having a mechanical coupling mechanism configured to mechanically attach the deactivator device to an exterior surface of a mPOS device, the housing having a multi-dimensional form factor which is approximately equal to or smaller than a multi-dimensional form factor of the mPOS mobile device.

2. The deactivator device according to claim 1, wherein each electromagnet includes a linear core with an electrically conductive coil wrapped thereabout.

3. The deactivator device according to claim 2, wherein one of the electromagnets is configured such that an upper end defines the north pole thereof and the other of the electromagnets is configured such that the lower end defines the north pole thereof.

4. The deactivator device according to claim 1, wherein the capacitor is positioned between the spaced apart electromagnets.

5. The deactivator device according to claim 4, wherein the capacitor has a depth approximately equal to a depth of the electromagnets.

6. The deactivator device according to claim 1, wherein a return bar is positioned between the electromagnets and the electronics assembly.

7. The deactivator device according to claim 1, wherein the microcontroller provides the deactivation or activation pulse upon receipt of an activation signal from a trigger.

8. The deactivator device according to claim 1, wherein the microcontroller provides the deactivation or activation pulse in a cyclical manner by cyclically opening and closing a switch between the capacitor and the electromagnets.

9. The deactivator device according to claim 1, wherein the deactivation or activation pulse utilizes a peak energy of approximately 0.5 Joules or less.

10. The deactivator device according to claim 1, wherein the deactivation or activation pulse is a decaying alternating sinusoidal current waveform.

11. The deactivator device according to claim 1, wherein the electromagnets, the battery, the capacitor and the electronics assembly are positioned within a housing.

12. The deactivator device according to claim 11, wherein the battery is rechargeable and the housing defines a charging input associated with the battery and microcontroller to facilitate charging of the battery.

13. The deactivator device according to claim 11, wherein a trigger in communication with the microcontroller is supported by the housing.

14. The deactivator device according to claim 1, wherein the housing includes one or more clips configured to couple the housing to the mPOS device.

15. A mobile Point of Sale (mPOS) assembly comprising:

a mPOS device configured to carry out at least one point of sale transaction; and a deactivator device including:

a pair of spaced apart, fixed position electromagnets positioned and configured such that magnetic fields generated by the electromagnets aid one another to form a combined magnetic field;

a battery;

a capacitor;

an electronics assembly including a microcontroller configured to control storage of energy from the battery in the capacitor and to selectively provide a deactivation or activation pulse from the capacitor to the electromagnets; and a housing having (1) a mechanical coupling mechanism configured to mechanically attach the deactivator device to an exterior surface of the mPOS device and (2) a multi-dimensional form factor which is approximately equal to or smaller than a multi-dimensional form factor of the mPOS device.

16. The mPOS assembly according to claim 15 wherein the electromagnets, the battery, the capacitor and the electronics assembly are positioned within a housing.

17. The deactivator device according to claim 16 wherein the mechanical coupling mechanism includes one or more clips.

* * * * *